United States Patent [19]

Asterö

[11] 4,187,571

[45] Feb. 12, 1980

[54] MANUALLY MOVABLE BINDING APPARATUS

[75] Inventor: Ulf J. E. Asterö, Tumba, Sweden

[73] Assignee: Asthausbolagen HB Asterö & Stockhaus, Tumba, Sweden

[21] Appl. No.: 918,511

[22] Filed: Jun. 23, 1978

[30] Foreign Application Priority Data

Jun. 27, 1977 [SE] Sweden ..... 7707406

[51] Int. Cl.[2] ..... B42C 9/02

[52] U.S. Cl. ..... 11/1 AD; 11/4

[58] Field of Search ..... 11/1 R, 1 AD, 3, 4; 281/21 R, 22, 23

[56] References Cited

U.S. PATENT DOCUMENTS

| | | | |
|---|---|---|---|
| 1,274,154 | 7/1918 | Etheridge | 11/4 |
| 1,543,378 | 6/1925 | Frazier et al. | 11/1 R |
| 3,223,436 | 12/1965 | Becker | 281/21 R |
| 3,668,037 | 6/1972 | Blair | 11/1 AD |

*Primary Examiner*—John McQuade

*Attorney, Agent, or Firm*—Burns, Doane, Swecker & Mathis

[57] ABSTRACT

Apparatus for binding bundles of paper comprising band folding means for attaching a band to an edge of a bundle, wherein the band folding means is divided into three parts and comprises in series a press plate and a pair of band folders facing each other, at least the plate being suspended in spring means acting in direction to the upper edge of the bundle, the folders being spring-urged against each other, and the band folding means being arranged to act against the upper edge of the bundle.

8 Claims, 3 Drawing Figures

MANUALLY MOVABLE BINDING APPARATUS

The invention relates to an apparatus for binding bundles of paper, comprising a band folding means for attaching a band, preferably a binding band provided in advance with a binder, for example a thermal plastic, to an edge of the bundles.

Devices of said type are wholly or partly known from for example Swedish patent specifications Nos. 160 414, 166 779 and 322 758 and the Swedish published patent applications Nos. 72-11321, 74-07426-1, and 75-07632-3.

Moreover, similar devices of interest are known from U.S. Pat. Nos. 3,466,682 and 3,727,256 and to some extent from U.S. Pat. No. 3,863,957.

Furthermore, devices of the type introductorily mentioned are known from West German patent specifications Nos. 605 745, 821 185, 846 986 and from DOS Nos. 1810088 and 2264336.

The known devices are generally designed for binding of series of paper bundles of a constant thickness and are not suited for binding successive bundles of a varying thickness.

Moreover, the known devices are generally arranged so that the binding takes place at the lower edge of the bundle, which means that the binder under the influence of gravity tends to move away from the binding edge of the bundles.

Furthermore, the known devices are designed as total plants, wherein a very large part of the binding of the paper bundles is automated, including feeding of the bundles through the apparatus, guiding the bundles through the apparatus, triming the binding edges of the bundles etc., and thereby the known devices are expensive to buy, in view of which they are used mainly only in printing factories etc. Contrary to this, this invention has for an object to provide a binding apparatus which is structurally simple and thereby can be manufactured at a low cost and can find use even in relatively small offices and the like, wherein it is often desirable to be able to bind bundles of stenciled paper to compends without having to make holes in the separate papers, provide for a loose-leaf cover for every bundle of paper and to provide staff for inserting the bundles of paper in the loose-leaf covers.

The apparatus according to the invention eliminates the above disadvantages and provides for said objects by its structure which essentially is characterized by the fact that the band folding means is divided into three parts and comprises in series a press plate and a pair of juxtaposed band folders, at least the plate being suspended in spring means acting in direction to the upper edge of the bundle, and the folders being spring-urged against each other, the bandfolding means being arranged to act against the upper edge of the bundles so that the binder or glue which is applied to the edge of the bundle by gravity is held into contact with and distributed across the binding surfaces.

The apparatus according to the invention as well as embodiments thereof are closer defined in the appended patent claims. The binding band is preferably a textile or plastic band which is impregnated or coated with a thermoplastic material, and in this case the band folding means is heated, preferably electrically heated, so that the thermoplastic binder will be softened for adherence against the edge of the bundle when passing the band folding means. The apparatus according to the invention further suitably includes a bearing means for mounting a roll of the band material and is preferably associated with a knife which is arranged in connection to the folding means and is maneuverable for severing the band. The knife is suitably arranged between the press plate and and the pair of folders. The plate is suitably curved to allow for successive pressing of the band against the edge of the bundle at relative movement between the bundle and the folding means. The folders are preferably designed so that each of them have an upper flange arranged to move in contact with the band on the binding edge of the bundle, and a side flange arranged to bring a rim part of the band into contact with one side surface of the bundle, the side flange preferably being curved so as to successively engage the rim part of the band against the side surface of the bundle. In the case where the binder is not supplied to the band in advance a glue distributing means is suitably arranged to meter the glue onto the edge of the bundle when a bundle is moved relative to the apparatus, the band being then positioned on top of the metered glue. The glue distributing means may be arranged to allow for metering of glue only when contacted by a bundle edge and for this purpose one can utilize means known per se, such as contact valves or the like.

The apparatus according to the invention is suitably designed as an "iron", i.e. a housing which on its upper side is provided with a handle, the lower side of the housing having a longitudinally extending recess, which is put over the binding edge of the bundle and moved thereover. The bundle should normally be positioned vertically, the edge to be bound facing upwardly. In order to prepare the bundles for the binding operation it may often be suitable first to level out the edges of the bundles and then to clamp the bundles in blocking devices, for example two plates positioned on opposite sides of the bundle close to the binding area of the bundle, said plates being pressed against each other by means of clamping means. If a number of binding operations are to be carried out several bundles may be clamped in a clamping block for each bundle and if desired a particular table may be arranged for the clamping blocks so that the blocks and thereby the bundles will be aligned along the table, in view of which the binding apparatus according to the invention only need to be moved across the row of aligned upstanding bundles.

The apparatus according to the invention will in the following be further described in the form of an exemplifying embodiment with reference to the appended drawings.

Figure 1:
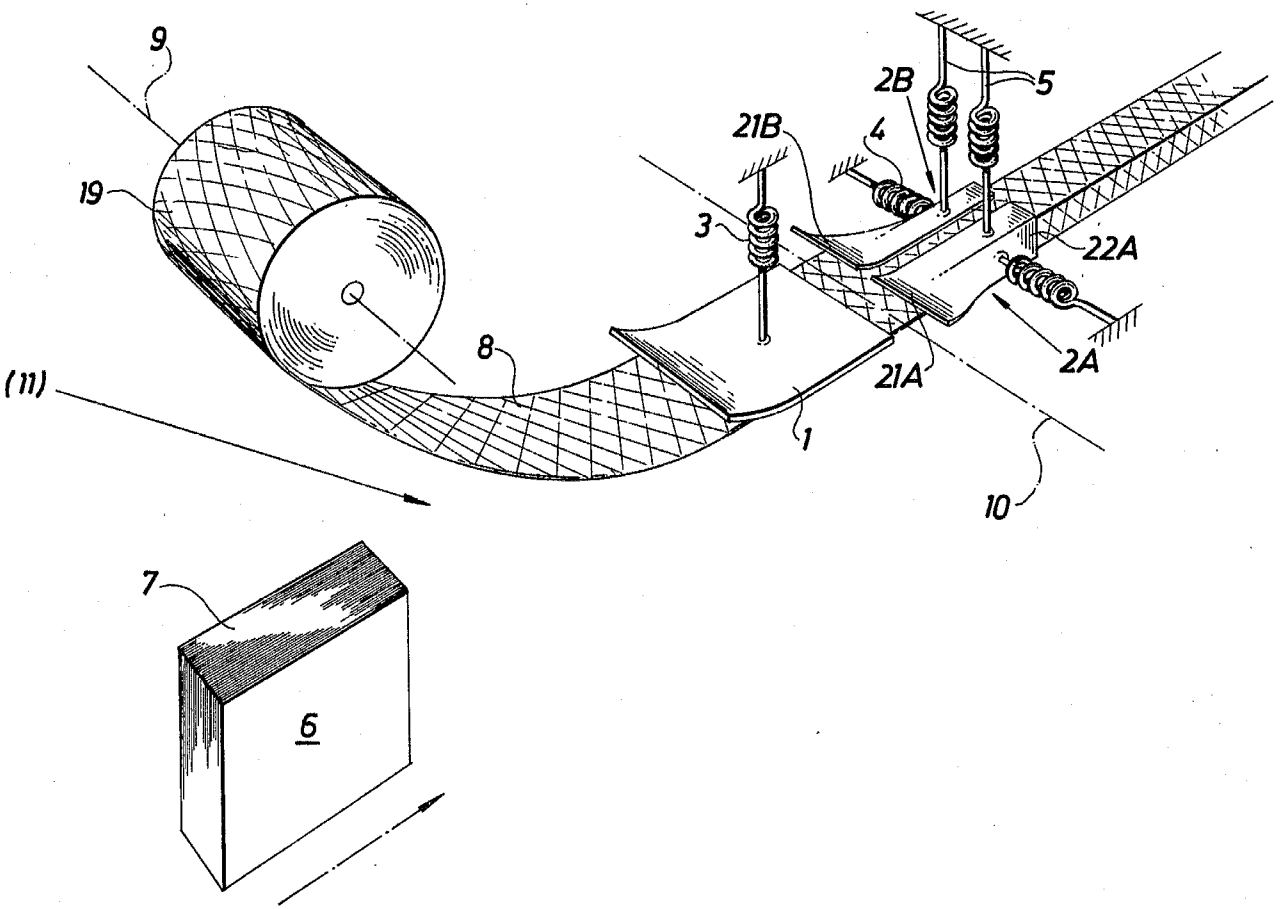
FIG. 1 shows diagramatically in perspective the essential elements of the apparatus according to the invention.

In FIG. 1 there is shown a plastic band or textile band 8 coated with or provided with a binder of the heat-sensitive type. Band 8 is fed from a storage roll 19 which is mounted on an axis 9 in the housing of the apparatus (not shown). Moreover, the apparatus includes a band press plate 1, the leading edge of which is somewhat bent upwardly. Plate 1 is vertically resiliantly dispensed relative housing by means of spring 3. Downstream of the plate 1 a pair of band folders 2A, 2B are arranged.

Springs 5 are provided vertically between housing and band folders and springs 4 are arranged horizontally between housing and band folders. In this manner band folders 2A, 2B as well as plate 1 will be resiliently mounted in a vertical direction, and band folders 2A, 2B are also spring-urged against each other. A bundle 6 for binding is positioned with its edge 7 prepared for binding facing upwardly and is brought into contact with band 8. Band 8 is positioned on top of edge 7 of bundle 6 and the upper heated plate provides for softening of of the binder so as to adhere against edge 7 of the bundle. When bundle 6 is moved to the right in FIG. 1 relative to the apparatus of the invention the band will thus be laid out on the edge of the bundle and is initially ironed to attachment by means of the electrically heated plate 1. Band folders 2 will then progressively bring the rim parts of band 8 to engagement with the side surfaces adjacent to edge 7 under influence of spring 4.

Bundles 6 may have varying thickness and in view of the resiliant dispension of folders 2A, 2B an excellent engagement of band 8 will be obtained.

Alternatively, band 8 may be a reinforcement band only, the apparatus including a binder supply device 11 which, for example, may be arranged to be opened when contacting the bundle 6 for application of binder against the binding edge or back 7 of bundle 6.

Moreover, the apparatus includes a knife 10 which is illustrated diagramatically only. Knife 10 is suitably hand-operated.

As is clear from the drawing the front edges of folders 2A, 2B are somewhat upwardly bent to prevent damages from arising on band 8. Folders 2A, 2B have at the front end a substantially horizontal flange, the outer rim of which is progressively bent down against the rear part of the flange so that each of folders 2A, 2B at rear parts have a horizontal flange part 21A, 21B and a vertical flange as, for example, at 22A. In view of this arrangement the rim parts of band 8 extending beyond the binding back 7 of bundle 6 will progressively contact and be pressed against the bundle when the bundle has moved through the apparatus. Also folders 2A, 2B are heated, suitably electrically heated.

In the cases where band 8 is provided with a heat-sensitive binder the binder will adhere to the bundle in view of the supplied heat. In those cases where band 8 is merely a reinforcement band the supply of heat will make the binder, (which is supplied in rather fluid condition) to provide for adhesion of the band against the bundle.

Figure 2:
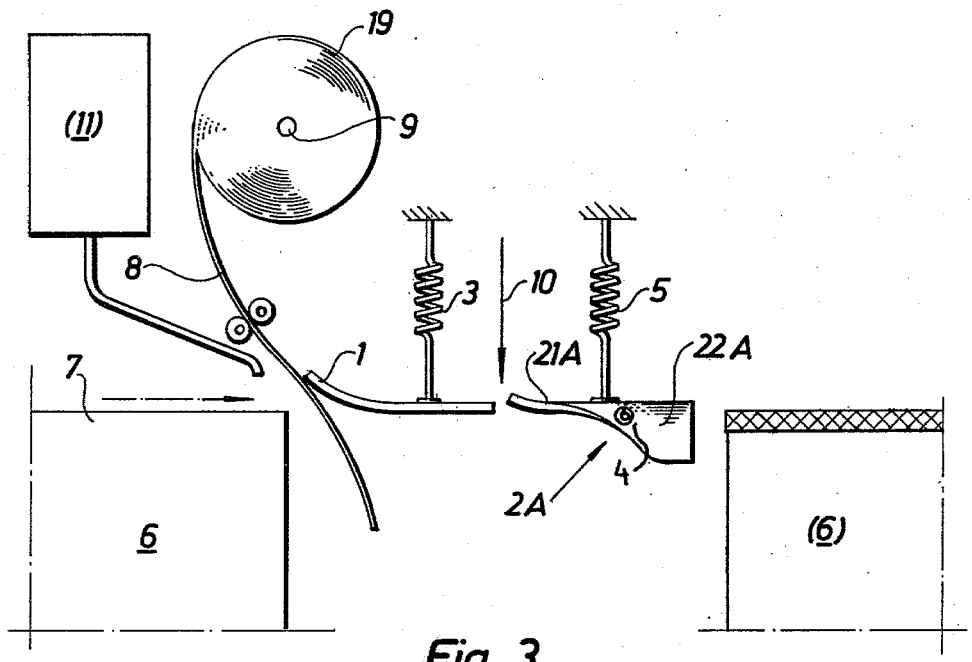
FIG. 2 shows diagramatically a side view of the apparatus according to FIG. 1.
Figure 3:
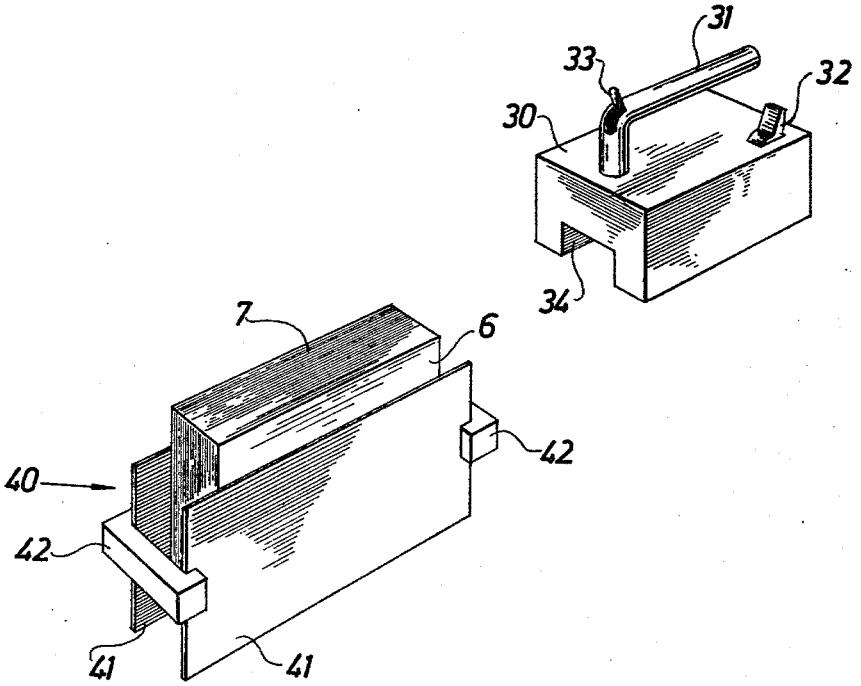
FIG. 3 shows diagramatically a housing for the apparatus of FIGS. 1 and 2 and a bundle prepared for binding.

FIG. 3 shows the housing 30 of the apparatus of FIGS. 1 and 2. Housing 30 is suitably provided with a handle 31, a switch 32 for controlling the supply of current to plate 1 and the heating element of the folders 2A, 2B. Moreover, the housing 30 suitably has a control button 33 for knife 10. At its lower side the housing 30 is provided with a longitudinally extending recess 34, by which plate 1 and folders 2A, 2B are associated in the interior of the housing. Bundle 6 is clamped in a clamping block generally designated 40. Block 40 includes two clamping plates 41 which are movable against each other by means of tensioning members 42. The clamping block may be arranged to be positioned vertically on a table or the like so that the operator only has to move the housing across the upper free binding back 7 of the bundle. Alternatively, block 40 may have flanges (not shown), by which block 40 may rest lowered into a slit in a particular working table (not shown), whereby possible stability problems with regard to bundle 6 and block 40 are avoided.

Within the scope of the invention the illustrated apparatus may be modified in several manners. Thus, it is conceivable to connect the feeding of the band with the contact with the bundle so that band cannot be metered except when the bundle is in contact with for example the upper heat plate and has displaced said plate somewhat upwardly, further metering of band being prevented for example when the rear edge of the bundle has passed plate 1.

What is claimed is:

1. In an apparatus for binding bundles of paper, comprising means for holding a bundle of paper as a unit, and a binding means comprising a band folding means for attaching a band provided with a binder to an edge of the bundle, the band folding means being divided into a press means acting on the bundle edge and, in series therewith, a pair of band folders facing each other and acting on the bundle rims adjacent the bundle edge; the improvement wherein: the bundle holding means is a stationary apparatus and the binding means is mounted in a housing adapted to be manually moved along the upper edge of the bundle; further wherein the press means is a press plate which is spring urged toward the upper edge of the bundle and both of the band folders acting on the upper rims of the bundle are spring urged toward each other so as to accommodate for varying bundle thicknesses.

2. Apparatus according to claim 1, characterized in that the folders (2A, 2B) are mounted in spring means (5) acting against the upper edge of the bundle.

3. A binding apparatus as set forth in claim 1, wherein the housing comprises bearing means for mounting a roll of band material.

4. A binding apparatus as set forth in claim 1, wherein a knife for severing the band is positioned between the press plate and the pair of band folders.

5. A binding apparatus as set forth in claim 1, wherein the press plate is curved to allow for successive pressing of the band against the binding edge of the bundle, further wherein the pair of band folders are arranged trailing the plate in the path of movement of the housing over the upper edge of the bundle.

6. A binding apparatus as set forth in claim 1, wherein each of the band folders have an upper flange arranged to contact the band on the binding edge of the bundle and a side flange arranged to bring a peripheral portion of the band into engagement with the upper rim portion of the side surface of the bundle, the side flanges being curved so as to successively engage the peripheral portion of the band against the side surface of the bundle.

7. A binding apparatus as set forth in claim 1, further including a glue distributing means for metering glue onto the upper edge of a bundle when the housing is moved along the upper edge of the bundle prior to the band being positioned on the edge of the bundle.

8. A binding apparatus as set forth in claim 1, wherein the band folding means includes heating means.

* * * * *